United States Patent [19]

Borrelli et al.

[11] 4,341,863

[45] Jul. 27, 1982

[54] ARCHIVAL OPTICAL RECORDING MEDIUM

[75] Inventors: Nicholas F. Borrelli, Elmira; Arthur J. Whitman, Horseheads, both of N.Y.; Peter L. Young, North Wales, Pa.

[73] Assignee: Corning Glass Works, Corning, N.Y.

[21] Appl. No.: 190,519

[22] Filed: Sep. 25, 1980

[51] Int. Cl.[3] ..... G03C 1/28

[52] U.S. Cl. ..... 430/346; 430/496; 430/502; 430/523; 430/604; 430/363; 430/932; 430/945; 430/495

[58] Field of Search ..... 430/932, 346, 495, 496, 430/604, 564, 599, 605, 502, 523, 363, 945

[56] References Cited

U.S. PATENT DOCUMENTS

| | | | |
|---|---|---|---|
| 4,239,338 | 12/1980 | Borrelli et al. | 350/155 |
| 4,246,337 | 1/1981 | Borrelli et al. | 430/604 |
| 4,275,141 | 6/1981 | Borrelli et al. | 430/604 |

OTHER PUBLICATIONS

R. A. Bartolini, "Optical Recording Media Review", SPIE vol. 123, Optical Storage Materials and Methods, (1977), pp. 2–9.

*Primary Examiner*—Won H. Louie, Jr.
*Attorney, Agent, or Firm*—Kees van der Sterre

[57] ABSTRACT

An optical information storage medium comprising a thin, optically darkenable film containing silver, lead, chlorine and oxygen, produced by vapor-depositing AgCl and PbO in specified proportions on a substrate for the film, is described.

7 Claims, 2 Drawing Figures

ARCHIVAL OPTICAL RECORDING MEDIUM

BACKGROUND OF THE INVENTION

The present invention is in the field of optical information storage and particularly relates to a new thin film optical information storage medium based on a silver halide-containing film which stores information by irreversibly darkening on exposure to intense light.

Optical recording has gained commercial interest in recent years because of its promise of extremely high information storage density. At present, the recording material favored for such use is a thin film of a tellurium-based alloy. Recording in this medium is accomplished by focusing a laser beam to a 1-micron diameter spot, burning a hole in the tellurium film and thereby increasing the transparency of the medium.

Even though high recording density and sensitivity have been demonstrated in this material, serious problems relating to the long term stability of the medium remain, due to the fact that oxidation of the medium can occur in storage. A useful comparison of the various optical information storage technologies is provided by R. A. Bartolini in the article "Optical Recording Media Review," SPIE Vol. 123 *Optical Storage Materials and Methods* (1977), pages 2–9.

The photosensitivity of silver halide crystals is well known and silver halide-based systems are still being investigated for possible use in digital optical information storage systems. Silver halide-based films which do not require chemical development when used as information storage media have recently been described by N. F. Borrelli and P. L. Young in two commonly assigned copending patent applications, Ser. No. 901,428 filed May 1, 1978 and Ser. No. 86,813 filed Oct. 22, 1979. The media described in these applications incorporate films which are light-absorbing as made, and which can be efficiently altered to a dichroic, birefringent state by exposure to polarized light.

The silver halide films described by Borrelli et al. are multilayer films produced by the repeated sequential deposition of thin silver chloride layers and an inorganic chemical agent which develops additive coloration in each of the silver chloride layers by a limited partial reduction of some of the silver chloride to metallic silver. The characteristic light absorption and optical bleaching properties of these films have been attributed to the presence therein of additively colored silver chloride crystals, a crystal phase thought to comprise silver metal in combination with AgCl crystals. Lead oxide is one chemical agent which has been found effective to induce additive coloration in thin silver chloride layers, producing a highly colored, efficiently alterable information storage film.

Additively colored photosensitive films of the type above described are particularly useful for applications involving reuse because they are erasable and rerecordable simply by further exposure to light of an appropriate polarization. However, the long-term light sensitivity needed for such use can be viewed as a disadvantage where archival storage characteristics are desired, since continual high light sensitivity requires that the medium with its contained information be stored away from light. Thus a silver halide optical information storage medium offering good recording efficiency and archival information storage characteristics, yet not requiring a chemical development step, would still be desirable.

SUMMARY OF THE INVENTION

The present invention is based on the discovery of a new optically darkenable material consisting of a polycrystalline deposition product containing lead, silver, chlorine and oxygen as essential constituents. The material is formed by the vapor deposition of PbO and AgCl in proportions of about 30–70% PbO and 30–70% AgCl by weight onto a suitable surface.

The exact composition of the deposition product in terms of the actual compounds or elements present therein after deposition is not known, since one or more reaction products of a gas phase or solid interaction between PbO and AgCl appear to be present in the material in addition to or instead of the starting compounds per se. Thus, when disposed in the form of a thin layer on a transparent substrate the material is transparent and typically blue-to-violet in color in transmitted light although neither of the starting materials exhibits such coloration.

The material has been found to be rapidly darkenable to a deep red color on exposure to a strong light source such as a focused laser beam. The darkening mechanism has not been determined, but is believed to involve a phase change, probably induced by localized heating, which produces a large increase in optical density in exposed areas of the material.

Based on the above discovery, the invention comprises an optical information storage medium incorporating the new material as a thin, light-sensitive film on a supporting substrate, the film containing silver, lead, chlorine, and oxygen and being produced by vapor-depositing AgCl and PbO in proportions of about 30–70% PbO and 30–70% AgCl by weight on the substrate. For high density digital information storage applications the film will have a thickness not exceeding about 2 microns.

The films of the invention differ from previous photosensitive silver chloride-lead oxide films as to both composition and structure. The present films include a relatively large proportion of lead or lead oxide, and do not exhibit bleaching, dichroism or birefringence on exposure to polarized light. Their spectral absorption characteristics are substantially different from additively colored silver chloride films; light absorption is present but does not appear to be entirely due to metallic silver as in previous films. Finally, while the present films may have an alternating layered structure resulting from the sequential deposition of silver chloride and lead oxide layers, they may also be substantially homogeneous, produced, for example, by the codeposition of these two compounds.

Relying upon the photosensitive behavior of the material above described, the invention further comprises a method for optically storing information in a medium by exposing the medium to light to develop high contrast optical density variations therein, the medium incorporating a polycrystalline vapor deposition product containing lead, silver, chlorine and oxygen, produced by the vapor deposition of PbO and AgCl in proportions of about 30–70% PbO and 30–70% AgCl by weight. Preferably the polycrystalline deposition product will be provided as a thin film on a supporting substrate, the film having a thickness not exceeding about 2 microns.

BRIEF DESCRIPTION OF THE DRAWINGS

The invention may be further understood by reference to the drawings, wherein.

DETAILED DESCRIPTION

While the reasons for the difference in light responsive behavior between the AgCl-PbO films of the prior art and those of the present invention are not fully understood, it has been determined that film appearance and behavior depend strongly on the relative concentrations of silver and lead in the films. In the case of a typical prior art film, wherein PbO is added in only minor proportions (typically less than about 10% by weight), a purple-to-red coloration attributed to the presence of additively colored silver chloride crystals is normally exhibited and high levels of induced dichroism and birefringence are obtainable.

As the relative amount of PbO in the film is increased to the levels presently found useful, these characteristics disappear and a composition area within the scope of the invention is reached wherein the films exhibit substantially broader absorption of visible light. Such films appear blue to violet in transmitted light and, moreover, darken rather than bleach upon exposure to strong light.

Figure 1:
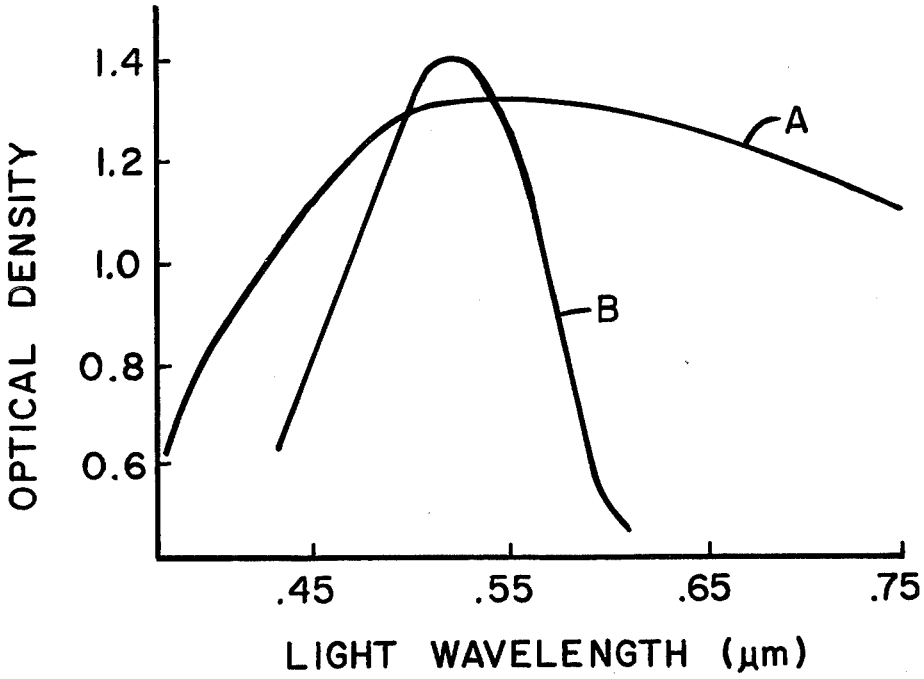
FIG. 1 is a graph plotting optical density as a function of light wavelength for a typical film provided in accordance with the invention (A) and a film provided in accordance with the prior art (B)

A typical optical density curve for a film provided in accordance with the invention is shown as Curve A in FIG. 1 of the drawing. An optical density curve for a lead oxide-containing additively colored silver chloride film of the prior art, exhibiting the rather pure coloration of additively colored silver chloride, is shown as Curve B. A comparison of these curves suggests that coloring species other than metallic silver in silver chloride may be present in the films of the invention.

As previously noted, films within the scope of the invention may be provided either by the codeposition of PbO and AgCl on a suitable film substrate or by alternating layer deposition on the substrate. The presently preferred procedure from the standpoint of process control is that of alternating layer deposition, a previously utilized technique wherein thin layers of PbO and AgCl are alternately applied to the substrate. As previously noted, the overall thickness of the film is desirably kept below about 2 microns, in order to insure the high resolution needed for optical recording, but the number of layers and the thickness of the layers can vary considerably depending upon the characteristics required in the film product.

In a typical alternating layer arrangement, evaporated PbO layers ranging in thickness from about 120–250 Å alternating with evaporated AgCl layers of a thickness between about 200–400 Å are provided. As is well known, evaporated layers of such thickness are not necessarily continuous, so that the thickness values reported herein are in all cases effective thickness values, obtained by dividing the weight of a deposited layer by the product of the layer area and density.

The number of layers in a deposited film can also vary considerably, from as few as one layer each of AgCl and PbO to 100 layers or more. However, no advantage has yet been obtained by exceeding about 5 layers each of PbO and AgCl.

Conventional vacuum coating devices can be used to provide these films, particularly where codeposition is the technique employed for film production, but apparatus such as described in a copending, commonly assigned application by A. J. Whitman et al., Ser. No. 135,131, filed Mar. 28, 1980, is particularly preferred for use when an alternating layer structure is desired. As described in the Whitman et al. application, expressly incorporated by reference herein for a more complete description of a suitable coating method and apparatus, a multilayer film composed of two or more different constituents can be produced by attaching a film substrate to a rotatable substrate holder and moving that substrate by rotating the holder repeatedly over two or more evaporation boats containing the various compounds to be evaporated onto the substrate. The thicknesses of the evaporated layers can be regulated by controlling the rotation speed of the substrate holder and the temperatures of the evaporation boats.

No criticality has been found in the selection of a substrate for the deposition of the evaporated film. Any transparent, translucent or opaque substrate composed of glass, plastic or another suitable material could be used as a support in an optical information storage medium provided according to the invention. However, it has been found desirable to prepare the films under conditions of relatively low humidity (≦40% RH) to enhance the environmental stability thereof.

Writing in the films of the invention can be accomplished simply by exposing the film to intense light for a time sufficient to achieve darkening, which as previously noted is presently thought to occur by a process of localized heating. Because the films exhibit rather broad absorption of visible and near- infrared light, the wavelength of light used to darken the film is not believed to be critical. We have used focused red HeNe laser light (wavelength 6328 Å) to darken these films, but other intense visible or infrared light sources could alternatively be employed.

Because darkening in these films apparently occurs by localized heating, it is manifested as a threshold effect, rather than as the product of a relatively slow accumulation of exposure. Darkening occurs rapidly if light above the minimum required power density is applied to the film, but does not occur at all, even upon prolonged exposure, if the light source is weak. Using a light source with an incident surface power density of about $10^5$ W/cm$^2$, very rapid (submicrosecond) darkening can readily be achieved in films within the scope of the present invention.

The invention may be further understood by reference to the following illustrative example setting forth a specific procedure for making and using a film provided in accordance therewith.

EXAMPLE

In a relatively dry environment, a film substrate consisting of a glass slide is thoroughly cleaned and positioned in a vacuum chamber on a rotating substrate holder above a pair of electrically heatable evaporation boats. One of the evaporation boats contains a small quantity of sliver chloride and the other contains a small quantity of lead oxide. A vertical baffle plate positioned between the two evaporation boats and below the rotating substrate holder isolates the boats from one another, substantially dividing the vacuum chamber into two compartments. By this means, vapors evolved from the first evaporation boat are kept from intermingling with the contents of the second boat, and vice versa.

After the substrate has been mounted on the holder, the vacuum chamber is closed and evacuated to a pressure of about $5\times10^{-6}$ torr. The evaporation boats are then moderately heated, while covered, to outgas the silver chloride and lead oxide therein.

After outgassing, th PbO-containing boat is heated to initiate the evaporation of lead oxide therefrom, the boat cover is removed, and rotation of the substrate holder is commenced at a speed of about 10 r.p.m. The PbO-containing evaporation boat is maintained during rotation at a temperature providing a film deposition rate of about 0.9 Å/second on the substrate, with rotation being continued to insure uniform deposition until a PbO film about 175 Å in thickness is provided.

Thereafter, PbO deposition is halted and the AgCl-containing boat is heated to a temperature providing a film deposition rate of about 6 Å/second, with rotation of the substrate holder being continued until a silver chloride layer about 300 Å in thickness has been provided.

The above procedure of PbO layer deposition and AgCl layer deposition is repeated until 4 PbO layers and 4 AgCl layers have been deposited on the glass substrate, each of the PbO layers being about 175 Å in thickness and each of the AgCl layers being about 300 Å in thickness.

Following the deposition of this multilayer film, dry air is readmitted to the vacuum chamber and the chamber is opened and the film and supporting substrate are removed and examined. The film appears violet in transmitted light, exhibiting light absorption characteristics quite similar to those shown by optical density Curve A in FIG. 1 of the drawings.

Following film deposition, the film and substrate are tested as an optical information storage medium by exposure to laser light. The slide with its supported film is attached to a rotating chuck and rotated through an optical exposure station, the slide surface moving through the exposure point at a speed of about 5 meters/second. With each passage through this station the film is exposed to the focused output of a 5 mW HeNe laser (light wavelength 6328 Å), the laser being cycled on and off at high frequency to impart short exposure tracks to the film. The laser beam is focused to a 1.5 micron-diameter spot on the film using a 0.5 NA lens, providing a surface power density of about $2\times10^5$ W/cm$^2$ at the film surface. The energy input for recording under those conditions is calculated at about 60 mJ/cm$^2$.

Figure 2:
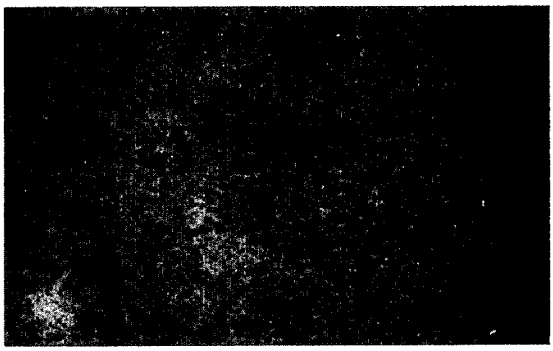
FIG. 2 is a photomicrograph taken in transmitted light of a recording medium bearing information recorded as light-induced optical density variations according to the invention.

FIG. 2 of the drawing is a photomicrograph in transmitted light at a magnification of 450X taken through a region of the film exposed to the laser in the fashion above described. The dark exposure tracks produced by the cycling laser beam are clearly shown in this Figure, the intermittent exposure pattern resulting from the fact that the laser was being cycled on and off at approximately one microsecond intervals. The high contrast between the darkened and undarkened regions of the exposed film is readily apparent.

Of course the foregoing description is merely illustrative of films and film deposition methods which could be adapted to the practice of the invention by those skilled in the art. Numerous variations and modifications thereupon may of course be resorted to within the scope of the appended claims.

We claim:

1. An optical information storage medium which includes a light-sensitive film in the form of a layer containing a polycrystalline deposition product of silver, lead, chlorine and oxygen, produced by vapor-depositing AgCl and PbO in proportions of about 30–70% PbO and 30–70% AgCl by weight, as calculated on the total weight of the film, on a substrate.

2. An optical information storage medium which includes a light-sensitive film in the form of alternating layers containing a polycrystalline deposition product of silver, lead, chlorine and oxygen, produced by vapor-depositing alternating layers of AgCl and PbO on a substrate, wherein PbO is deposited in a proportion of about 30–70% by weight and AgCl is deposited in a proportion of about 30–70% by weight as calculated on the total weight of the film.

3. An optical information storage medium in accordance with claim 2 wherein the PbO layers have a thickness in the range of 120–250 Å and the AgCl layers have a thickness in the range of 200–400 Å.

4. An optical information storage medium in accordance with claim 3 which comprises 2–5 layers of PbO and 2–5 layers of AgCl.

5. An optically darkenable material consisting essentially of a polycrystalline deposit of silver, lead, chlorine and oxygen, produced by the vapor deposition of PbO and AgCl in a layer on a substrate in proportions of about 30–70% PbO and 30–70% AgCl by weight.

6. A method for optically storing information in the form of optical density variations in a light-sensitive medium which comprises the step of exposing the medium to light, wherein the medium contains a polycrystalline deposition product of lead, silver, chlorine, and oxygen produced by the vapor deposition on a substrate of a layer or alternating layers of PbO and AgCl in proportions of about 30–70% PbO and 30–70% AgCl by weight as calculated on the total weight of the layers.

7. A method in accordance with claim 6 wherein the light-sensitive medium is disposed on a film substrate in the form of a vapor-deposited film having a thickness not exceeding about 2 microns, comprising alternating layers of PbO and AgCl.

* * * * *